US005268008A

United States Patent [19]

Kanne

[11] Patent Number: 5,268,008

[45] Date of Patent: Dec. 7, 1993

[54] HYDROCARBON FUEL COMPOSITION

[75] Inventor: Diane D. Kanne, Yorba Linda, Calif.

[73] Assignee: Union Oil Company of California, Los Angeles, Calif.

[21] Appl. No.: 611,972

[22] Filed: Nov. 13, 1990

Related U.S. Application Data

[63] Continuation of Ser. No. 671,570, Nov. 15, 1984, abandoned, which is a continuation-in-part of Ser. No. 453,494, Dec. 27, 1982, abandoned.

[51] Int. Cl.[5] ..... C10L 1/18

[52] U.S. Cl. ..... 44/444

[58] Field of Search ..... 44/444

[56] References Cited

U.S. PATENT DOCUMENTS

| | | | |
|---|---|---|---|
| 1,482,420 | 4/1926 | Nikaido | 44/57 |
| 2,128,987 | 9/1938 | Christensen | 44/56 |
| 2,221,839 | 11/1940 | Lipkin | 44/443 |
| 2,327,835 | 8/1943 | White | 44/58 |
| 2,763,537 | 9/1956 | Barusch et al. | 44/326 |
| 2,840,613 | 6/1958 | Howk et al. | 568/595 |
| 2,841,479 | 7/1958 | Hefner et al. | 44/58 |
| 3,258,496 | 6/1966 | Kesslin et al. | 568/695 |
| 3,318,812 | 5/1967 | Coffield | 44/444 |
| 3,594,138 | 7/1971 | Badin | 44/352 |
| 3,615,292 | 10/1971 | Badin | 44/363 |
| 3,817,720 | 6/1974 | Moy et al. | 44/56 |
| 3,820,962 | 6/1974 | Johnson | 44/56 |
| 3,857,897 | 12/1974 | Findeisen et al. | 568/595 |
| 3,869,262 | 3/1975 | Mayerhoffer et al. | 44/56 |
| 3,876,708 | 4/1975 | Speh et al. | 568/595 |
| 3,903,006 | 9/1975 | Elliott et al. | 568/595 |
| 4,182,910 | 1/1980 | Schmidt et al. | 568/595 |
| 4,240,801 | 12/1980 | Desmond, Jr. | 44/57 |
| 4,261,702 | 4/1981 | Sweeney | 44/52 |
| 4,302,214 | 11/1981 | Sweeney | 44/56 |
| 4,333,739 | 6/1982 | Neves | 44/52 |
| 4,390,344 | 6/1983 | Sweeney | 44/56 |
| 4,390,417 | 6/1983 | Sweeney | 44/56 |
| 4,395,267 | 7/1983 | Sweeney | 44/444 |
| 4,397,655 | 8/1983 | Sweeney | 44/56 |
| 4,541,837 | 9/1985 | Norten | 44/444 |
| 4,647,288 | 3/1987 | Dillon | 44/52 |
| 4,891,049 | 1/1990 | Dillon et al. | 44/53 |
| 4,904,279 | 2/1990 | Kanne et al. | 44/70 |
| 5,004,480 | 4/1991 | Kanne | 44/387 |

FOREIGN PATENT DOCUMENTS

| | | |
|---|---|---|
| 0014992 | 3/1980 | European Pat. Off. . |
| 2911411 | 9/1980 | Fed. Rep. of Germany . |
| 0119212 | 8/1947 | Sweden . |
| 0238693 | 12/1940 | Switzerland . |

OTHER PUBLICATIONS

Stinson, Karl W., *Diesel Engineering Handbook*, 10th Ed., Diesel Publications, Inc., Stamford, Conn., p. 112 (1959).

SEA Technical Paper Series, No. 902173, "The Effects of Diesel Ignition Improvers in Low-Sulfur Fuels on Heavy-Duty Diesel Emissions", Lawrence J. Cunningham, Timothy J. Henley, & Alexander M. Kulinowski, International Fuels and Lubricants Meeting and Exposition, Tulsa, Okla., Oct. 22-25, 1990.

"Advances in Diesel Particulate Control", SP-816, Society of Automotive Engineners, Inc., Feb. 1990, 35-66, 79-86.

Hydrocarbon Fuel Composition Containing Alpha-Ketocarboxylate Additive.

"Carboxylic Ortho Acid Derivatives," DeWolfe, *Organic Chemistry: A Series of Monographs*, Ed. Blomquist, vol. 14, Academic Press, 1970 (pp. 2, 3, 56, 57, 64, 65, 70, 71, 120, 121, and 134-146.

*Primary Examiner*—Margaret Medley
*Attorney, Agent, or Firm*—Gregory F. Wirzbicki

[57] ABSTRACT

Hydrocarbon fuels, especially diesel fuel compositions, contain orthoesters to reduce particulate emissions therefrom when combusted in an internal combustion engine.

33 Claims, No Drawings

HYDROCARBON FUEL COMPOSITION

CROSS-REFERENCE TO RELATED APPLICATIONS

This application is a continuation of U.S. patent application Ser. No. 671,570, filed Nov. 15, 1984, which itself is a continuation-in-part of U.S. patent application Ser. No. 453,494, filed Dec. 27, 1982, now abandoned.

BACKGROUND OF THE INVENTION

This invention relates to organic particulate emissions suppressant additives and hydrocarbon fuels containing the additives These additives are useful for reducing soot, smoke and particulate emissions from hydrocarbon fuels.

The petroleum industry has encountered numerous problems in supplying hydrocarbon fuels, especially middle distillate fuels suitable for use in compression ignition and jet engines One problem associated with combustion of hydrocarbon fuels in these engines is that they contribute materially to pollution of the atmosphere through soot, smoke and particulate emissions in engine exhaust gases.

Soot is the particulate matter resulting from heterogeneous combustion of hydrocarbon fuels, especially middle distillate fuels. When present in sufficient particle size and quantity, soot in engine exhaust gases appears as a black smoke. Soot formation in engine exhaust gases is highly undesirable since it causes environmental pollution, engine design limitations and possible health problems.

Diesel-type engines are well known for being highly durable and reliable under severe operating conditions. Because of this durability and reliability, diesel-type engines have long been used in heavy-duty motor vehicles, such as trucks, buses and locomotives. Recently, however, the automotive industry is using diesel-type engines in passenger automobiles and light-duty trucks to achieve greater fuel economy and conserve petroleum fuel. This increased use of diesel-type engines materially adds to pollution of the atmosphere through increased soot, smoke and particulate emissions in engine exhaust gases.

Several attempts have been made in the past to reduce emissions from diesel-type engines through the use of additives to middle distillate fuels. For example, U.S. Pat. No. 3,817,720 relates to organic smoke suppressant additives and distillate hydrocarbon fuels containing the same. The preferred organic additive is an ether of hydroquinone. These compounds are ethers of phenolic-type compounds which contain two oxygen atoms attached to each phenyl moiety.

Another hydrocarbon fuel additive, disclosed in U.S. Pat. No. 4,302,214, is a diether compound having low molecular weight. These compounds are described as suitable for increasing the octane number of gasoline.

The suppression of particulate emissions from diesel engines is described in U.S. Pat. No. 4,240,802 which discloses the addition of a minor amount of a cyclopentadienyl manganese tricarbonyl and a lower alkyl or cycloalkyl nitrate to a hydrocarbon fuel. These compounds are described as useful in reducing particulate emissions of fuel oil.

As can readily be determined from the above, there is an ongoing effort to develop liquid hydrocarbon fuels, especially middle distillate fuels, having particulate emissions suppressant properties.

Accordingly, it is an object of the present invention to provide hydrocarbon fuel compositions having enhanced particulate emissions suppressant properties.

Another object of the present invention is to provide a middle distillate fuel composition having reduced soot and smoke emissions properties.

Other objects and advantages of the invention will be apparent from the following description.

SUMMARY OF THE INVENTION

The present invention resides in a hydrocarbon fuel composition having particulate emissions suppressant properties which comprises a hydrocarbon fuel and a sufficient amount of at least one orthoester so as to reduce the amount of particulate emissions from the combustion of the fuel.

DETAILED DESCRIPTION OF THE INVENTION

The present invention resides in a hydrocarbon fuel having particulate emissions suppressant properties. For the purposes of the present invention, a hydrocarbon fuel shall mean either a liquid or gaseous hydrocarbon fuel. In particular, the present invention relates to hydrocarbon fuel compositions comprising at least one orthoester so as to reduce the particulate emissions resulting from the combustion of the hydrocarbon fuel. It should be noted that reference to orthoester is inclusive of both a single species of orthoester and to a mixture of species of orthoesters. Preferably the orthoester is of the formulae:

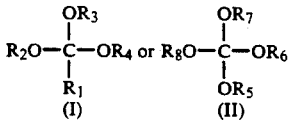

(I) (II)

where $R_1$ is hydrogen or a mono-valent organic radical comprising from 1 to about 20 carbon atoms and $R_2$, $R_3$, $R_4$, $R_5$, $R_6$, $R_7$, and $R_8$ are the same or different mono-valent organic radicals comprising from 1 to about 20 carbon atoms.

Preferably, $R_1$ is hydrogen or a straight or branched chain alkyl, alkenyl, alkynyl, or cycloalkyl radical having from 1 to about 10 carbon atoms, and more preferably 1 to about 6 carbon atoms. $R_2$, $R_3$, and R are the same or different, straight or branched chain alkyl, alkenyl, or alkynyl radicals having 1 to about 6 carbon atoms, and more preferably 1 to about 3 carbon atoms.

Preferably, $R_5$, $R_6$, $R_7$, and $R_8$ are the same or different mono-valent radical derived from an aliphatic, alicyclic or aromatic compound comprising from 1 to about 10 carbon atoms. Still more preferably $R_5$, $R_6$, $R_7$, and $R_8$ are the same or different mono-valent radical derived from an aliphatic or alicyclic compound comprising from 1 to about 10 carbon atoms and still more preferably the same or different alkyl, alkenyl or alkynyl radical comprising from 1 to about 10 carbon atoms.

Examples of an orthoester of the formula I type are trimethyl orthoacetate, dimethylethyl orthoacetate, diethylmethyl orthoacetate, di-n-propylethyl orthoacetate, di-n-butylethyl orthoacetate, trimethyl orthopropionate, trimethyl orthobutyrate, dimethylpentyl orthoformate, trimethyl orthoisobulyrate, diethylmethyl orthohexanoate, diisobutylethyl orthoformate, trimethyl orthocyclohexanecarboxylate trimethyl ortho-paratoluate, or trimethyl orthobenzoate or mixtures thereof. The preferred orthoester of the formula I type is trimethyl orthoacetate.

Examples of orthoesters of the formula II type are a tetraalkyl orthocarbonate, such as, tetramethyl orthocarbonate, tetraethyl orthocarbonate, tetrapropyl orthocarbonate, tetrabutyl orthocarbonate, trimethylbutyl orthocarbonate, dimethyldibutyl orthocarbonate, or tetra-n-hexyl orthocarbonate, or other orthocarbonates, such as, tetraphenyl orthocarbonate. The preferred orthoester of the formula II type is tetramethyl orthocarbonate.

Generally, the composition is comprised of a hydrocarbon fuel and a sufficient amount of at least one orthoester to reduce the particulate emissions from the combustion of the fuel. Preferably, the orthoester is present in a sufficient amount to reduce the particulate emissions for the combustion of the fuel by at least about 5 weight percent. Still more preferably, the orthoester is present in an amount from about 0.05 to about 49 volume percent, more preferably from about 0.5 to about 9 volume percent, and still more preferably from about 0.1 to about 5 volume percent based upon the total volume of fuel and orthoester. Typically, the orthoester is admixed by dissolution into the hydrocarbon fuel.

As stated above, hydrocarbon fuels useful for the practice of the present invention include both liquid and gaseous hydrocarbon fuels, such as, residue fuels, petroleum middle distillate fuels, such as, kerosene, diesel fuels, aviation fuels, or heating oils, methane, ethane, propane, acetylene, or natural gas. It should be noted that any hydrocarbon fuel in which the orthoesters can be admixed to prepare a composition in accordance with the present invention is suitable for the purposes of the present invention. Preferably, the hydrocarbon fuels useful for the present invention are essentially free of alcohol, that is, the fuel contains less than about 1 volume percent alcohol based upon the volume of hydrocarbon fuel. Typically, the alcohol is present as a carrier for any of the known fuel additives. Preferably, the hydrocarbon fuel is a petroleum middle distillate fuel, propane or acetylene, and more preferably diesel fuel or acetylene.

The preferred distillate hydrocarbon stocks useful for preparing the fuel oil compositions of this invention are generally classified as petroleum middle distillates boiling in the range of 350° F. to 700° F. and have cloud points usually from about −78° F. to about 45° F. The hydrocarbon stock can comprise straight run, or cracked gas oil, or a blend in any proportion of straight run and thermally and/or catalytically cracked distillates, etc. The most common petroleum middle distillate hydrocarbon stocks are kerosene, diesel fuels, aviation fuels, and heating oils.

A typical heating oil specification calls for a 10 percent ASTM D-1160 distillation point no higher than about 440° F., a 50 percent point no higher than about 520° F., and a 90 percent point of at least 540° F., and no higher than about 640° F. to 650° F., although some specifications set the 90 percent point as high as 675° F.

A typical specification for a diesel fuel includes a minimum flash point of 100° F., a boiling point range of from about 300° F. to about 700° F. and a 90 percent distillation point (ASTM D-1170) between 540° F. and 640° F., i.e., 90 percent by volume boils below 640° F. (See ASTM Designation 496 and 975.)

An example of high cloud point diesel fuel is a 40° F. cloud point fuel having an initial boiling point of about 350° F., a 90 percent distillation point of about 733° F. and a final boiling point of about 847° F. (ASTM D-1160.)

The hydrocarbon fuel composition of the present invention may also comprise any of the known conventional additives, such as carburetor detergents, dyes, oxidation inhibitors, etc.

The following examples serve to further illustrate and instruct one skilled in the art the best mode of practicing this invention and are not intended to be construed as limiting thereof.

EXAMPLE I

Trimethyl orthoacetate is produced by adding a cooled mixture (32° F.) of 135 grams of acetonitrile, 109 grams of anhydrous methyl alcohol, 85 grams of anhydrous diethyl ether and 40 grams of dry hydrogen chloride to a 1 liter Pyrex glass flask. This mixture is allowed to stand in a refrigerator overnight at 32° F., during which the mixture solidifies into a cake of white, shining plates. The ether is decanted from the product and the product is dried under vacuum (1.0 mm Hg) over sodium lime for twenty-four hours to remove excess hydrogen chloride. The reaction produces the intermediate reaction product acet-imino-methyl-ether hydrochloride.

Next, 310 grams of acet-imino-methyl-ether hydrochloride, absolutely dry and free of hydrogen chloride is reacted with 409 grams of methyl alcohol in a 2 liter tightly stoppered Pyrex glass flask at room temperature with occasional shaking. Ammonium chloride formed in the reaction is removed by filtration. The filtrate is contacted with 2 grams of fused potassium carbonate to remove free hydrogen chloride. The reaction product is fractionated under a vacuum of 50 mm Hg at a temperature of 87° F. to recover trimethyl orthoacetate.

EXAMPLE II

Triethyl orthoacetate is produced by adding a cooled mixture (32° F.) of 135 grams of acetonitrile, 157 grams of anhydrous ethyl alcohol, 85 grams of anhydrous diethyl ether and 40 grams of dry hydrogen chloride to a 1 liter Pyrex glass flask. This mixture is allowed to stand in a refrigerator overnight at 32° F., during which the mixture solidifies into a cake of white, shining plates. The ether is decanted from the product and the product is dried under vacuum (1.0 mm Hg) over sodium lime for twenty-four hours to remove excess hydrogen chloride. The reaction produces the intermediate reaction product acet-imino-ethyl-ether hydrochloride.

Next, 350 grams of acet-imino-ethyl-ether hydrochloride, absolutely dry and free of hydrogen chloride is reacted with 590 grams of ethyl alcohol in a 2 liter tightly stoppered Pyrex glass flask at room temperature with occasional shaking. Ammonium chloride formed in the reaction is removed by filtration. The filtrate is contacted with 2 grams of fused potassium carbonate to remove free hydrogen chloride. The reaction product is fractionated under a vacuum of 50 mm Hg at a temperature of 152° F. to recover triethyl orthoacetate.

EXAMPLES III TO V

Diesel fuel compositions are tested for particulate emissions suppressant properties in an Onan Series 3.0 DJA-3CR, single-cylinder, four-stroke, indirect-injection, diesel engine coupled to an Onan AC generator. A diesel particulate sampling system is used consisting of a model No. 771889 assembly filter holder from a Beckman Constant Volume Sampling (CVS) System, having vacuum fittings at both ends. The sampling filter holder is fitted with a fluorocarbon coated glass-fiber filter, having a diameter of 70 mm and manufactured commercially by Pallflex, Inc. The filter holder is connected to the diesel engine exhaust system via an exhaust slipstream tap equipped with a ball valve located at a 90 degree angle. A rotary vane vacuum pump is connected to the filter holder and draws 8.5 cubic feet per minute (cfm) of diesel exhaust gas through the filter. The weight of particulates collected on the filter is determined by weighing the filter before an engine test to determine the filter tare weight and weighing the filter after the engine test to determine the weight of the filter plus the collected particles, then, the weight of the tare filter is subtracted from the weight of the filter containing the particulates.

The particulate emissions tests are conducted in accordance with the test conditions of Table 1.

TABLE 1

| Operating Conditions | |
|---|---|
| Test Duration, Each Test (minutes) | 20 |
| Speed, rpm | 1,800 ± 10 |
| Load on Generator (watts) | 2,800 |

| | Examples | | |
|---|---|---|---|
| | III | IV | V |
| Fuel Flow (g/run) | 377 ± 7.0 | 376 ± 6.7 | 369 ± 4.0 |
| Cylinder Head, °F. | 484 ± 7.5 | 472 ± 6.0 | 479 ± 12.1 |
| Oil, °F. | 213 ± 6.9 | 208 ± 3.0 | 215 ± 8.1 |
| Oil Pressure, p.s.i.g. | 35 | 35 | 35 |
| Intake Air, °F. | 87 ± 6.5 | 76 ± 8.3 | 84 ± 9.6 |
| Relative Humidity, % | 59 ± 6.5 | 78 ± 5.4 | 68 ± 15.7 |

Each one-day test has the following test sequence:
(1) 45 minute warmup on #2 diesel fuel
(2) 20 minute particulate test
(3) fuel change over to #2 diesel fuel plus additive
(4) 30 minute conditioning or fuel plus additive
(5) 20 minute particulate test
(6) fuel changeover to #2 diesel fuel
(7) 30 minute conditioning on #2 diesel fuel
(8) repeat sequence 2 through 7.

Diesel fuel samples containing the additive are tested for particulate emissions and the results are summarized in Table 2 below:

TABLE 2

| Example No. | Total Number of Runs | Particulate Collection Rate, #2 Diesel Fuel gms/ft$^3$ of Exhaust Gas × $10^4$ | Particulate Collection Rate, #2 Diesel Fuel Containing 0.55 wt. % of TMOA[a], gms/ft$^3$ of Exhaust Gas × $10^4$ | Reduction in Emissions, % |
|---|---|---|---|---|
| III | 5 | 2.095 ± 0.08 | 1.789 ± 0.056 | 14.61 |
| IV | 7 | 1.999 ± 0.12 | 1.794 ± 0.085 | 10.26 |
| V | 6 | 1.990 ± 0.20 | 1.395 ± 0.112 | 29.90 |

[a]TMOA = Trimethyl orthoacetate

EXAMPLES VI to IX

Diesel fuel compositions are tested for particulate emissions suppressant properties in accordance with the procedure described in Examples III to V with the following exceptions:

TABLE 3

| Test Duration, Each Test (minutes) | 20 |
|---|---|
| Speed, rpm | 1,800 ± 10 |
| Load on Generator (watts) | 2,800 |

| | Examples | | | |
|---|---|---|---|---|
| | VI | VII | VIII | IX |
| Fuel Flow (g/run) | 360 ± 7.1 | 377 ± 3.8 | 378 ± 2.9 | 382 ± 4.5 |
| Cylinder Head, °F. | 488 ± 4.2 | 474 ± 8.3 | 477 ± 7.8 | 485 ± 7.3 |
| Oil, °F. | 216 ± 5.4 | 207 ± 7.5 | 206 ± 4.0 | 213 ± 7.2 |
| Oil Pressure, p.s.i.g. | 35 | 35 | 35 | 35 |
| Intake Air, °F. | 102 ± 5.2 | 86 ± 9.7 | 77 ± 5.3 | 88 ± 5.2 |
| Relative Humidity, % | 34 ± 14.3 | 66 ± 14.4 | 73 ± 11.6 | 59 ± 6.1 |

Diesel fuel samples containing the additive in Table 4 below are tested for particulate emissions and the results are summarized in Table 4 below:

TABLE 4

| Example No. | Total Number of Runs | Particulate Collection Rate, #2 Diesel Fuel gms/ft$^3$ of Exhaust Gas × $10^4$ | Particulate Collection Rate, #2 Diesel Fuel Containing 1.1 wt. % of TMOA[a], gms/ft$^3$ of Exhaust Gas × $10^4$ | Reduction in Particulate Emissions, % |
|---|---|---|---|---|
| VI | 7 | 1.535 ± 0.28 | 1.250 ± 0.12 | 18.57 |
| VII | 5 | 2.139 ± 0.10 | 1.882 ± 0.04 | 12.01 |
| VIII | 5 | 2.288 ± 0.03 | 1.874 ± 0.22 | 18.09 |
| IX | 6 | 2.345 ± 0.06 | 2.080 ± 0.17 | 11.30 |

[a]TMOA = Trimethyl orthoacetate

EXAMPLES X TO XII

Trimethyl orthoacetate is tested for particulate emissions suppressant properties as an additive for #2 diesel fuel in a 1982 Oldsmobile Cutlass Ciera LS equipped with a 4.3 liter diesel engine. The Cutless automobile was placed on a chassis dynamometer and tested for particulate emissions in accordance with the procedure disclosed in 40 CFR , Part 86 [FLR 1011-7]as published in Vol. 45, No. 45 of the Federal Register on Mar. 5, 1980, with the following exceptions: the individual tests were conducted over an eight-hour period. Particulate samples were collected from the automobile exhaust using a Beckman Constant Volume Sampling (CVS) System. The diesel motor is tested in the following sequence during the eight-hour period:
(a) warmup at 50 mph for 45 min. using #2 diesel fuel
(b) base run, #2 diesel fuel 64 min.)
(c) fuel changeover and warmup at 50 mph (45 min.)
(d) #2 diesel fuel plus additive (64 min.)
(e) #2 diesel fuel plus additive (64 min.)
(f) fuel changeover and warmup at 50 mph (45 min.)
(g) base run, #2 diesel fuel (64 min.)

The results are summarized in Table 5 below:

TABLE 5

| Example No. | Total Number of Runs | Particulate Collection Rate, #2 Diesel Fuel gms/mi | Particulate Collection Rate, #2 Diesel Fuel Containing 0.55 wt. % of TMOA[a], gms/mi | Particulate Collection Rate, #2 Diesel Fuel Containing 1.1 wt. % of TMOA[a], gms/mi | Reduction in Particulate Emissions, % |
|---|---|---|---|---|---|
| X | 5 | 0.3722 ± 0.06 | — | — | -0- |
| XI | 2 | — | 0.2723 ± 0.04 | — | 27 |
| XII | 1 | — | — | 0.2700 ± 0.08 | 27 |

[a]TMOA = Trimethyl orthoacetate

The data in Table 5 above prove that a #2 diesel fuel containing trimethyl orthoacetate reduces particulate emissions in an Oldsmobile diesel engine by 27 percent when compared to a #2 diesel fuel which does not contain the compound.

EXAMPLES XIII THROUGH XVIII

The following examples demonstrate the reduction of particulate emissions from the combustion of a No. 2 diesel fuel containing tetramethyl orthocarbonate. No. 2 diesel fuel containing no tetramethyl orthocarbonate (TMOC) and TMOC at varying levels is combusted with the particulate emmisions measured. The procedure for measuring the particulate emissions involves combusting a No. 2 diesel fuel in an Onan Series 3.0 MDJA-3CR, single-cylinder, four-stroke, indirect-injection, diesel engine coupled to an Onan AC generator. A mini-dilution tunnel for simulation of the atmospheric dilution process is fitted to the exhaust system of the Onan engine. Solid particulate emissions samples are collected by introducing a portion of the Onan engine raw exhaust into the throat of a dilution nozzle via a heated exhaust sampling line equipped with a t-valve. Raw exhaust is drawn into the throat's low pressure region by flowing prefiltered air from a compressed air source through the converging-diverging nozzle. The raw exhaust is diluted at an air to raw exhaust volume ratio of 13.7:1. The dilute exhaust sample is flowed through the mini-dilution tunnel mixing zone, and a portion of the dilute exhaust is drawn from the dilution tunnel into a particulate emissions sampling system comprising a model No. 771889 assembly filter holder from a Beckman Constant Volume Sampling (CVS) system which has vacuum fittings at both ends. The sampling filter holder is fitted with a fluorocarbon-coated glass-fiber filter, which has a diameter of 70 mm and is manufactured commercially by Pallflex, Inc. A rotary vane vacuum pump is connected to the filter holder and draws 1.83 cubic feet per minute (cfm) of dilute diesel exhaust gas through the filter. The weight of particulate matter collected on the filter is determined by weighing the filter before an engine test to determine the filter tare weight, weighing the filter after an engine test to determine the weight of filter plus collected particulate matter, and subtracting the filter tare weight from the weight of filter plus collected particulates.

In conducting the measurement of the particulate emissions for each example the following sequence is carried out:

(1) 45 minute warmup on No. 2 diesel fuel
(2) 30 minute particulate test
(3) fuel change over to No. 2 diesel fuel plus additive
(4) 30 minute conditioning on No. 2 diesel fuel plus additive
(5) 30 minute particulate test
(6) fuel change over to No. 2 diesel fuel
(7) 30 minute conditioning on No. 2 diesel fuel
(8) repeat sequence 2 through 7 twice
(9) repeat step (2) once.

The testing conditions for each example is indicated below in Table 6. The results of the testing is indicated below in Table 7 for No. 2 diesel fuel without any tetramethyl orthocarbonate (TMOC) and at 2.4 weight percent (wt. %) and 3.5 wt. % TMOC loadings. As shown by the test results, TMOC does effect a reduction in particulate emissions, with even a small addition (2.4 wt. %) providing greater then 5% reduction.

TABLE 6

| Parameter | Examples XIII | XIV | XV | XVI | XVII | XVIII |
|---|---|---|---|---|---|---|
| Speed (revolution per minute) | 1,800 ± 10 | 1,800 ± 10 | 1,800 ± 10 | 1,800 ± 10 | 1,800 ± 10 | 1,800 ± 10 |
| Load on Generator (watts) | 2,400 | 2,400 | 2,400 | 2,400 | 2,400 | 2,400 |
| Fuel Flow (grams/run) | 482 ± 22.0 | 482 ± 5.5 | 484 ± 4.0 | 489 ± 10.6 | 483 ± 10.8 | 478 ± 4.9 |
| Temperatures (°F.) | | | | | | |
| Cylinder Head | 187 ± 1.7 | 185 ± 0.8 | 188 ± 1.8 | 184 ± 1.0 | 187 ± 1.5 | 187 ± 3.4 |
| Oil | 153 ± 2.4 | 146 ± 2.5 | 145 ± 6.1 | 161 ± 4.1 | 163 ± 2.9 | 164 ± 1.6 |
| Intake Air | 76 ± 2.5 | 71 ± 3.1 | 73 ± 1.9 | 70 ± 2.0 | 76 ± 3.0 | 76 ± 1.8 |
| Oil Pressure (pounds per square inch of gas) | 30 | 30 | 30 | 30 | 30 | 30 |
| Total volume (cubic feet) | 55.0 ± 0.21 | 55.0 ± 0.10 | 55.2 ± 0.35 | 55.3 ± 0.15 | 54.9 ± 0.14 | 55.3 ± 0.13 |

TABLE 7

| | Examples XIII | XIV | XV | XVI | XVII | XVIII |
|---|---|---|---|---|---|---|
| Total No. of Runs | 7 | 7 | 7 | 7 | 7 | 7 |
| Particulate Collection (grams/30 minutes) | | | | | | |
| A. No. 2 Diesel Fuel | 4.93 ± 0.54 | 4.66 ± 0.44 | 4.85 ± 0.45 | 4.60 ± 0.61 | 5.08 ± 0.40 | 5.19 ± 0.39 |
| B. No. 2 Diesel Fuel 2.4 wt. % TMOC* | 4.60 ± 0.34 | 4.29 ± 0.10 | 4.33 ± 0.30 | | | |
| C. No. 2 Diesel Fuel 3.5 wt. % TMOC* | | | | 3.84 ± 0.40 | 4.43 ± 0.30 | 4.65 ± 0.20 |

TABLE 7-continued

| | Examples | | | | | |
|---|---|---|---|---|---|---|
| | XIII | XIV | XV | XVI | XVII | XVIII |
| Reduction (%) | 6.7 | 7.9 | 10.8 | 16.6 | 12.8 | 10.3 |

TMOC is tetramethyl orthocarbonate

EXAMPLES XIX THROUGH XXV

The following examples demonstrate the reduction of particulate emissions from the combustion of a gaseous hydrocarbon fuel, propane, containing TMOC. The procedure for measuring the particulate emissions involves combusting the propane in a laminar diffusion flame which is generated and stabilized using a 1.9 centimeter (cm) diameter capillary burner. The burner consists of three concentrically positioned stainless steel tubes which have respective inner diameters of 0.4 millimeters (mm), 1.1 mm and 1.8 centimeters. Positioned within and between these tubes are stainless steel hypodermic tubes (0.84 mm). Propane, the desired amount of orthocarbonate and nitrogen are provided through the central tube with oxygen and nitrogen provided through the middle tube. Through the outer concentric tube a shroud of nitrogen is provided to shield the flame from atmospheric oxygen. The oxygen, nitrogen, and propane are metered into the tubes of the burner through calibrated glass rotometers. The total flow rates of oxygen and nitrogen for all of the examples is 0.96 and 2.35 liters per minute (l/min), respectively. Particulate emission rates are measured as a function of the propane flow rate for each example as listed below in Table 8 for each example. The orthocarbonate is added through a 90° "pneumatic" atomizer and monitored with a motorized syringe pump. The burner is enclosed in a circular cross-section quartz chimney (7 cm inner diameter by 45 cm long) which is fitted with a filter holder for collecting particulate emissions.

The particulate emission rates are measured by drawing the exhaust out of the chimney through a fluorocarbon-coated glass fiber filter using a rotary vane vacuum pump. The weight of particulate matter collected on the filter is determined by weighing the filter before and after the test and subtracting the former from the later.

The test conditions for each example is indicated in Table 8 below with the results of the particulate emissions measurement for each example listed below in Table 9.

As seen above in Table 9, TMOC does effect a reduction in particulate emissions. The reduction is 1.1 percent and 1.5 percent with 0.85 mole percent and 0.94 percent TMOC loadings at propane flow rate of 0.25 l/min and 0.23 l/min, respectively, as seen by comparing Examples XXI with XIX and Examples XXIII with XX, respectively. When the TMOC loadings are increased to 2.49 mole percent and 2.75 mole percent at the same respective propane flow rates, the particulate emission rates decrease 5.0 percent and 5.1 percent, as seen by comparing Examples XXII with XIX and Examples XXIV with XX, respectively.

This application incorporates by reference in its entirety U.S. patent application Ser. No. 671,570, filed Nov. 15, 1984 now abandoned.

Obviously, many modifications and variations of the invention, as hereinbefore set forth, may be made without departing from the spirit and scope thereof, and therefore only such limitations should be imposed as are indicated in the appended claims.

What is claimed is:

1. A method for reducing the amount of particulates emitted during the combustion of a fuel comprising:

(1) combusting a fuel composition consisting essentially of a liquid hydrocarbon middle distillate fuel and at least one orthoester; and (2) collecting particulates produced by said combusting in step (1), said collecting being at a location downstream of the source of the combusting in step (1).

2. A method as defined in claim 1 wherein the orthoester is present in said fuel composition in a concentration such that the amount of particulates collected is at least 5 weight percent lower than if the same fuel composition but without the orthoester were combusted with particulates collected in like manner.

3. A method as defined in claim 1 wherein the orthoester is present in said fuel composition in a concentration such that the amount of particulates collected is at least 12.8 weight percent lower than if the same fuel composition but without the orthoester were combusted with particulates collected in like manner.

4. A method as defined in claim 1 wherein the orthoester is present in said fuel composition in a concentration such that the amount of particulates collected is at least 27 weight percent lower than if the same fuel composition but without the orthoester were combusted with particulates collected in like manner.

5. A method for reducing the amount of particulates emitted during the combustion of a fuel, said method comprising:

TABLE 8

| | Examples | | | | | |
|---|---|---|---|---|---|---|
| Parameters | XIX | XX | XXI | XXII | XXIII | XXIV |
| Test Duration (minutes) | 5 | 5 | 5 | 5 | 5 | 5 |
| Total Propane Flow Rate ( /min) | 0.25 | 0.23 | 0.25 | 0.25 | 0.23 | 0.23 |
| Total Oxygen Flow Rate ( /min) | 0.96 | 0.96 | 0.96 | 0.96 | 0.96 | 0.96 |
| Total Nitrogen Flow Rate ( /min) | 2.34 | 2.34 | 2.34 | 2.34 | 2.34 | 2.34 |
| Total TMOC Flow Rate (microliters per minute) | | | 12.75 | 38.00 | 12.75 | 38.00 |

TABLE 9

| Significance Example No. | mole % TMOC[2] | Mean Particulate Collection Rate, mg/min | No. of Tests | % Particulate Reduction[b] |
|---|---|---|---|---|
| XIX | | 10.98 ± 0.15 | 26 | |
| XX | | 11.44 ± 0.15 | 36 | |
| XXI | 0.85 | 10.86 ± 0.16 | 3 | 1.1 |
| XXII | 2.49 | 10.43 ± 0.17 | 3 | 5.0 |
| XXIII | 0.94 | 11.27 ± 0.09 | 4 | 1.5 |
| XXIV | 2.75 | 10.86 ± 0.21 | 4 | 5.1 |

(1) combusting a fuel composition consisting essentially of a liquid hydrocarbon diesel fuel and at least one orthoester in a diesel engine; and (2) collecting particulates produced by said combusting in step (1), said comprising separating particulates from exhaust gases produced by said combusting in a location external to the engine.

6. A method as defined in claim 5 wherein the orthoester is present in said fuel composition in a concentration such that the amount of particulates collected is at least 10.8 weight percent lower than if the same fuel composition but without the orthoester were combusted with particulates collected in like manner.

7. A method as defined in claim 5 wherein the orthoester is present in said fuel composition in a concentration such that the amount of particulates collected is at least 14.61 weight percent lower than if the same fuel composition but without the orthoester were combusted with particulates collected in like manner.

8. A method as defined in claim 5 wherein the orthoester is present in said fuel composition in a concentration such that the amount of particulates collected is at least 16.6 weight percent lower than if the same fuel composition but without the orthoester were combusted with particulates collected in like manner.

9. A method as defined in claim 5 wherein the orthoester is present in said fuel composition in a concentration such that the amount of particulates collected is at least 27 weight percent lower than if the same fuel composition but without the orthoester were combusted with particulates collected in like manner.

10. A method as defined in claim 5 wherein the orthoester is present in said fuel composition in a concentration such that the amount of particulates collected is at least 29.90 weight percent lower than if the same fuel composition but without the orthoester were combusted with particulates collected in like manner.

11. A method as defined in claim 5 wherein the orthoester is present in said fuel composition in a concentration such that the amount of particulates collected is at least 10.26 weight percent lower than if the same fuel composition but without the orthoester were combusted with particulates collected in like manner.

12. A method for reducing the amount of particulates emitted during the combustion of a fuel, said method comprising:

(1) adding an orthoester to a liquid hydrocarbon middle distillate fuel essentially free of alcohol; and (2) combusting said fuel in which the orthoester is added, said orthoester being added to said fuel in step (1) in an amount sufficient to provide a concentration thereof from 0.5 to 9 volume percent, based on the total volume of hydrocarbon middle distillate fuel and orthoester, and further sufficient to reduce the amount of particulates emitted from the fuel during said combusting in step (2) by at least 10.3 weight percent.

13. A method for reducing the amount of particulates emitted during the combustion of a fuel, said method comprising:

(1) adding an orthoester to a liquid hydrocarbon diesel fuel essentially free of alcohol; and (2) combusting said fuel in which the orthoester has been added in a diesel engine, said orthoester being added to said fuel in step (1) in an amount sufficient to provide a concentration thereof from 0.5 to 9 volume percent, based on the total volume of hydrocarbon diesel fuel and orthoester, and further sufficient to reduce the amount of particulates emitted from the fuel during said combusting in step (2) by at least 10.3 weight percent.

14. A method as defined in claim 13 wherein said orthoester is added to said fuel in step (1) in an amount sufficient to reduce the amount of particulates emitted from the fuel in step (2) by at least 14.61 weight percent.

15. A method as defined in claim 13 wherein said orthoester is added to said fuel in step (1) in an amount sufficient to reduce the amount of particulates emitted from the fuel in step (2) by at least 16.6 weight percent.

16. A method as defined in claim 13 wherein said orthoester is added to said fuel in step (1) in an amount sufficient to reduce the amount of particulates emitted from the fuel in step (2) by at least 27 weight percent.

17. A method as defined in claim 13 wherein said orthoester is added to said fuel in step (1) in an amount sufficient to reduce the amount of particulates emitted from the fuel in step (2) by at least 29.90 weight percent.

18. A method as defined in claim 17 wherein the products of combustion are passed through a means for collecting particulates and the particulates produced during said combustion are collected therein.

19. A method as defined in claims 1, 5, 2, 6, 7, 8, 9, 10, 11, 3, 4, 12, 13, 15 or 17 wherein said orthoester is of the formula:

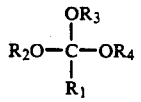

wherein $R_1$ is hydrogen or a straight or branched chain alkyl, alkenyl, alkynyl, or cycloalkyl radical having from 1 to about 10 carbon atoms, and $R_2$, $R_3$, and $R_4$ are the same or different mono-valent organic radical comprising 1 to about 20 carbon atoms.

20. A method as defined in claims 1, 5, 2, 6, 7, 8, 9, 10, 11, 3, 4, 12, 13, 14, 15, 16 or 17 wherein said orthoester is of the formula:

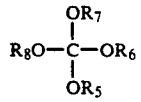

wherein $R_5$, $R_6$, $R_7$, and $R_8$ are the same or different mono-valent organic radical comprising 1 to about 20 carbon atoms.

21. A method as defined in claims 1, 7, 9, 10, 4, 12, 14, 17 or 18 wherein said orthoester is trimethyl orthoacetate.

22. A method as defined in claims 1, 6, 8, 3, 12, 13, 17 or 20 wherein said orthoester is tetramethyl orthocarbonate.

23. A method for reducing the amount of particulates emitted during the combustion of a fuel, said method comprising:

(1) adding an orthoester to a liquid hydrocarbon middle distillate fuel essentially free of alcohol, the orthoester being of formula:

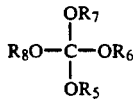

wherein $R_5$, $R_6$, $R_7$, and $R_8$ are the same or different mono-valent organic radical comprising 1 to about 20 carbon atoms; and (2) combusting said fuel in which the orthoester is added, said orthoester being added to said fuel in step (1) in ana mount sufficient to reduce the amount of particulates emitted from the fuel during said combusting in step (2).

24. A method as defined in claims 5, 10 or 3 wherein (a) said combusting is in an automotive diesel engine and (b) the concentration of said orthoester in said fuel composition is from 0.5 to 5.0 volume percent, based on the total volume of diesel fuel and orthoester.

25. A method as defined in claim 24 wherein said orthoester is of formula:

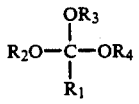

wherein $R_1$ is hydrogen or a straight or branched chain alkyl, alkenyl, alkynyl, or cycloalkyl radical having from 1 to about 10 carbon atoms, and $R_2$, $R_3$, and $R_4$ are the same or different mono-valent organic radical comprising 1 to about 20 carbon atoms.

26. A method as defined in claim 24 wherein said orthoester consists essentially of trimethyl orthoacetate.

27. A method as defined in claim 26 wherein said trimethyl orthoacetate is present in a concentration between 0.5 and about 3.0 volume percent.

28. A method as defined in claim 27 wherein said concentration is between about 2 and 3 volume percent.

29. A method as defined in claim 24 wherein said orthoester is of formula:

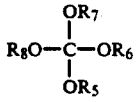

wherein $R_5$, $R_6$, $R_7$, and $R_8$ are the same or different mono-valent organic radical comprising 1 to about 20 carbon atoms.

30. A method as defined in claim 24 wherein said orthoester consists essentially of tetramethyl orthocarbonate.

31. A method as defined in claim 30 wherein said tetramethyl orthocarbonate is present in a concentration no greater than about 1 volume percent.

32. A method as defined in claims 1, 7, 10 or 13 wherein said orthoester is a tetraalkyl orthocarbonate.

33. A method as defined in claims 1, 7 or 13 wherein said orthoester is selected from the group consisting of dimethylethyl orthoacetate, diethylmethyl orthoacetate, di-n-propylethyl orthoacetate, di-n-butylethyl orthoacetate, trimethyl orthopropionate, trimethyl orthobutyrate, dimethylpentyl orthoformate, trimethyl orthiosobutyrate, diethylmethyl orthohexanoate, and diisobutylethyl orthoformate.

* * * * *

UNITED STATES PATENT AND TRADEMARK OFFICE

CERTIFICATE OF CORRECTION

PATENT NO. : 5,268,008

DATED : December 7, 1993

INVENTOR(S) : Diane D. Kanne

It is certified that error appears in the above-identified patent and that said Letters Patent is hereby corrected as shown below:

Column 11, line 5, (claim 5), after "said", insert -- collecting --.

Column 12, lines 24, (claim 19), delete "6," and "9,"; in line 25, delete "3,".

Column 12, lines 39, (claim 20), delete "6," and "9,"; in line 40, delete "3,", "14," and "16".

Column 12, line 54, (claim 22), between "8," and "3", insert -- 10, --; and change "13," to -- 15, --; in line 55, change "20" to -- 18 --.

Column 13, line 6, (claim 23), delete "ana mount" and insert therefor -- an amount --.

Column 14, line 25, (claim 33), between "7" and "or 13", insert -- , 10 --.

Signed and Sealed this

Nineteenth Day of July, 1994

Bruce Lehman

*Attest:*

BRUCE LEHMAN

*Attesting Officer*

*Commissioner of Patents and Trademarks*